US010870196B2

(12) United States Patent
Solar et al.

(10) Patent No.: US 10,870,196 B2
(45) Date of Patent: Dec. 22, 2020

(54) TOOL HAVING AN AUTO-ADJUSTING HANDLE

(71) Applicant: IDEAL Industries, Inc., Sycamore, IL (US)

(72) Inventors: Brenton Solar, Genoa, IL (US); James Davidson, St. Charles, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 216 days.

(21) Appl. No.: 16/038,655

(22) Filed: Jul. 18, 2018

(65) Prior Publication Data

US 2020/0023508 A1 Jan. 23, 2020

(51) Int. Cl.

| | |
|---|---|
| ***B25G 1/10*** | (2006.01) |
| ***B25G 1/02*** | (2006.01) |
| ***B25B 23/16*** | (2006.01) |

(52) U.S. Cl.

CPC ..... *B25G 1/102* (2013.01); *B25B 23/16* (2013.01); *B25G 1/025* (2013.01)

(58) Field of Classification Search

CPC ..... B25B 23/16; B25G 1/025; B25G 1/102
USPC ..... 81/489
See application file for complete search history.

(56) References Cited

U.S. PATENT DOCUMENTS 4,811,785 A * 3/1989 Weber ..... E21B 23/01 166/117.7
7,367,735 B2 * 5/2008 Kanari ..... A45D 40/205 16/430
7,540,679 B2 * 6/2009 Fukui ..... B25G 1/00 401/6
7,621,023 B2 * 11/2009 Pyatt ..... B25G 1/102 15/144.1
9,580,133 B2 * 2/2017 Aymar ..... B62K 21/26

FOREIGN PATENT DOCUMENTS

| | | |
|---|---|---|
| CN | 107127705 A | 9/2017 |
| DE | 202012102792 U1 | 8/2012 |
| EP | 2089189 B1 | 10/2012 |

OTHER PUBLICATIONS

ISA/US, Int. Search Report and Written Opinion issued on PCT application No. US19/41644, dated Nov. 8, 2019, 10 pages.

* cited by examiner

*Primary Examiner* — Hadi Shakeri
(74) *Attorney, Agent, or Firm* — Greenberg Traurig, LLP

(57) ABSTRACT

A tool has a working member, a plurality of expansion members, and a handle that is rotatable relative to the working member. The handle has a longitudinally extending chamber in which a portion of the working member having cam surfaces is disposed. The handle also has a plurality of slots in which the plurality of expansion members are disposed. When a torque is applied to the tool, the cam surfaces of the working member cooperate with the plurality of expansion members to cause at least a portion of each of the plurality of expansion members to be moved outwardly from the slots to thereby cause the handle to change from having a first cross-sectional shape to a second cross-sectional shape. At least one spring is interposed between each of the plurality of expansion members and the handle for causing the handle to revert back to the first cross-sectional shape upon a removal of the torque as applied to the tool.

10 Claims, 3 Drawing Sheets

TOOL HAVING AN AUTO-ADJUSTING HANDLE

BACKGROUND

Ergonomic handles for hand tools, such as screwdrivers, are generally known in the art.

By way of example, U.S. Pat. No. 4,768,406 describes a screwdriver, having a working member and a handle attached to the working member, wherein the handle is of a predetermined cross-sectional shape when the tool is at rest. When incremental torque is applied to the handle the handle changes from the predetermined cross-sectional shape to another cross-sectional shape. As a result, the screwdriver can have a cross-sectional shape, such as round, for low torque uses and a more suitable cross-sectional shape, such as oblong or triangular, for high torque uses. The handle will return to its predetermined cross-sectional shape when the high torque is released.

By way of further example, WO 2008/058873 describes a screwdriver with a handle, which has a hand gripping zone which can change its shape, for introducing a torque, comprising at least one portion of the hand gripping zone that is deformed when a torque is introduced, wherein the handle has a core part, bearing a blade, and a sleeve part, surrounding the core part, wherein the sleeve part can be turned with respect to the core part and the deforming of the portion of the hand gripping zone results from a rotational displacement of the sleeve part with respect to the core part. The deformable portion is a sub-portion of a soft plastic insert on the outside of the sleeve, which, as a radially inwardly protruding tooth, lies in a tooth gap of the core part.

SUMMARY

Described herein is an improved tool having an auto-adjusting handle. Generally, the tool has a working member, a plurality of expansion members, and a handle that is rotatable relative to the working member. The handle has a longitudinally extending chamber and a portion of the working member, having cam surfaces, is disposed in the chamber. The handle also has a plurality of slots in which the plurality of expansion members are disposed. When a torque is applied to the tool, the cam surfaces of the working member cooperate with the plurality of expansion members to cause at least a portion of each of the plurality of expansion members to be moved outwardly from the slots to thereby cause the handle to change from having a first cross-sectional shape to a second cross-sectional shape. At least one spring is interposed between each of the plurality of expansion members and the handle for causing the handle to revert back to the first cross-sectional shape upon a removal of the torque as applied to the tool.

In a preferred embodiment, the tool is in the form of screwdriver and the working member is in the form of a shaft having a fastener driving feature.

A better appreciation of the objects, advantages, features, properties, and relationships of the subject tool will be obtained from the following detailed description and accompanying drawings which set forth illustrative embodiments which are indicative of the various ways in which the principles of the described tool may be employed.

BRIEF DESCRIPTION OF THE DRAWINGS

For a better understanding of the tool hereinafter described, reference may be had to the attached drawings in which.

DETAILED DESCRIPTION

Figure 1:
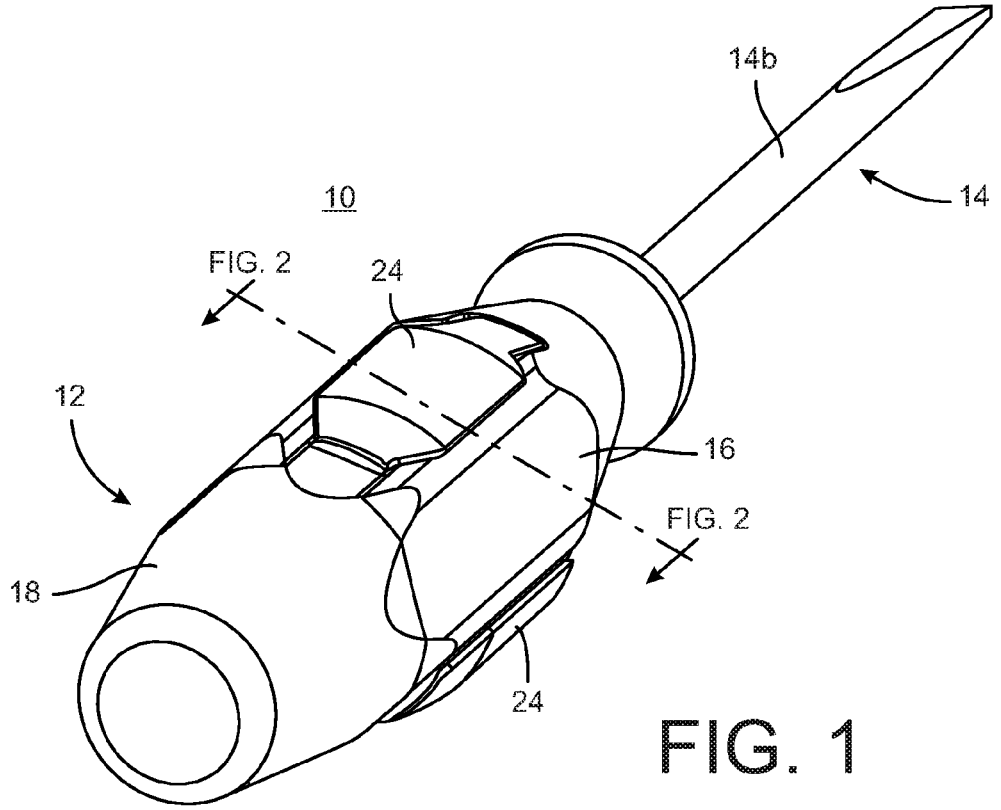
FIG. 1 illustrates a tool, in the exemplary form of a screwdriver, showing a handle of the tool when the tool is at rest.

The following describes a tool having an auto-adjusting handle. As will become apparent from the description that follows, the handle will automatically adjust its shape to provide a user with a better grip as the tool is being subjected to torque.

By way of non-limiting example, FIGS. 1-5 illustrate a tool in the form of a screwdriver 10 having a handle 12 and a working element 14. While the working element 14 is shown as being in the form of a shaft having a blade for driving a fastener, such as a flathead screw, it is to be understood that this is not intended to be limiting. Rather, those of skill in the art will appreciate that the tool 10 and/or the working element 14 can take other forms as needed for any particular purpose.

For ease in constructing the illustrated screwdriver 10, the handle 12 includes a first handle portion 16 and a second handle portion 18. The first handle portion 16 and the second handle portion 18, which may be formed from any suitable material, are to be attached to each other using any suitable attaching methodology and, when mated to form the handle 12, provide a longitudinally extending chamber 20 in which a first portion 14*a* of the working element 14 is to be positioned. The first handle portion 16 includes an opening through which a second portion 14*b* of the working element 14 will extend. As will be described in greater detail hereinafter, the working element 14, when positioned within the assembled handle 12, will be partially rotatable relative to the handle 12 and, accordingly, relative to handle expansion members 24 associated with the handle 12, to assist in providing the subject auto-adjusting grip.

For accommodating the handle expansion members 24, one or both of the first handle portion 16 and the second handle portion 18 are provided with a plurality of slots 22 such that, when the handle 12 is formed via the mating of the first handle portion 16 and the second handle portion 18, each slot 22 will carry a corresponding one of the handle expansion members 24. When positioned within the slots 22, the handle expansion members 24 will be capable of moving axially relative to the handle 12 in response to rotation of the working element 12 relative to the handle 12 to, as noted above, provide the auto-adjusting grip.

Figure 2:
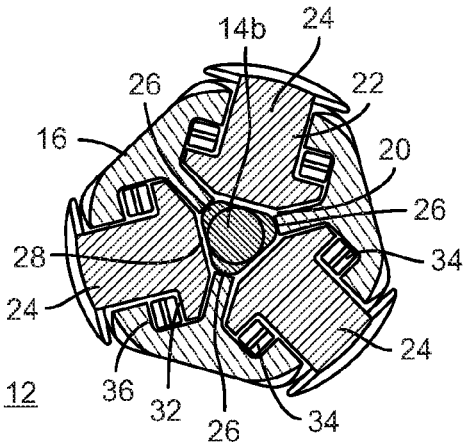
FIG. 2 illustrates a cross-sectional view of the handle taken along line II-II in FIG. 1.
Figure 3:
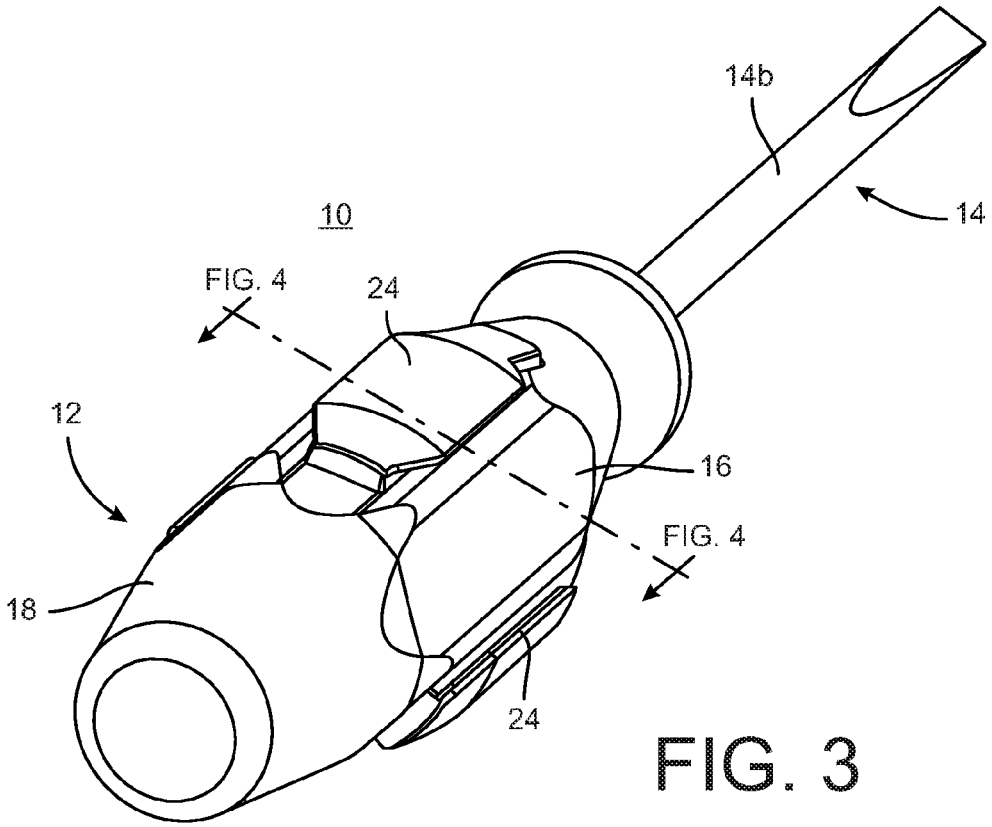
FIG. 3 illustrates the tool of FIG. 1 showing the handle of the tool when a torque is applied to the tool.
Figure 4:
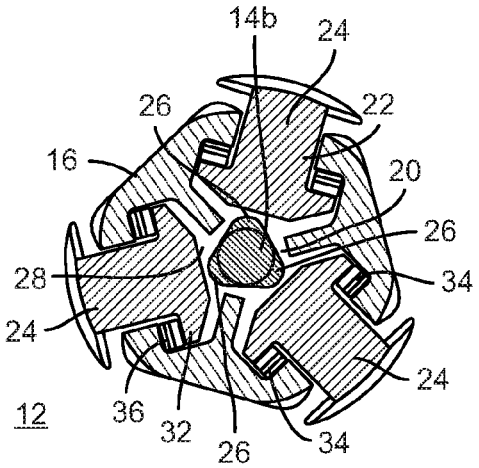
FIG. 4 illustrates a cross-sectional view of the handle taken along line 4-4 in FIG. 3.
Figure 5:
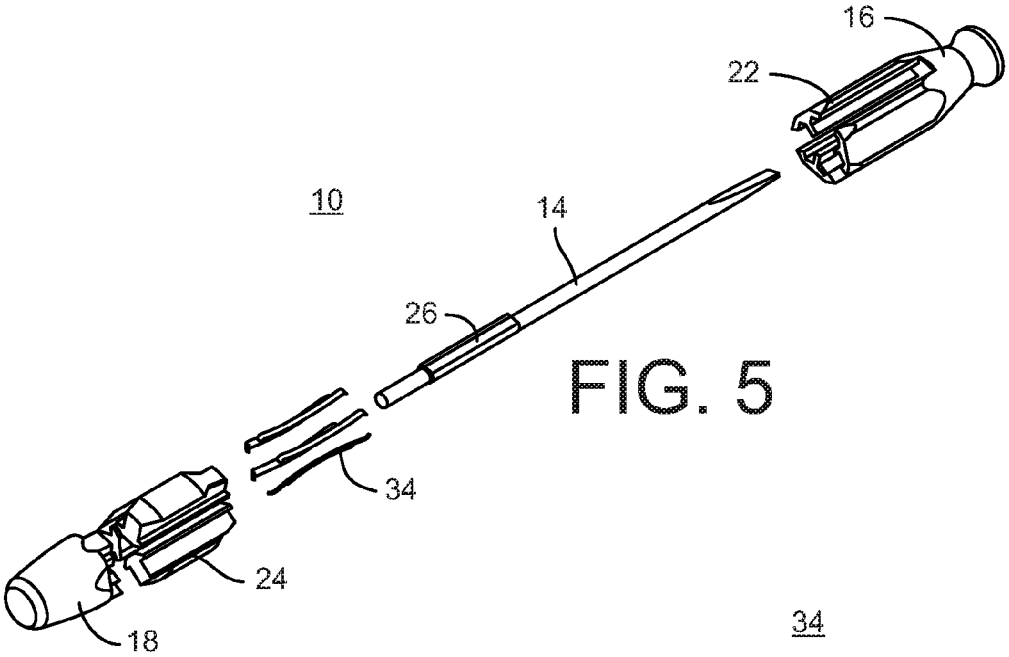
FIG. 5 illustrates an exploded view of the tool of FIG. 1.

More particularly, for providing the auto-adjusting grip, the second portion 14*b* of the working element 14 that is disposed within the chamber 20 includes a plurality of cam surfaces 26 that are adapted and arranged to engage with corresponding surfaces 28 provided to the handle expansion members 24. Thus, when the working element 14 is rotated relative to the handle 12 (in either a clockwise or counter-clockwise direction), the cam surfaces 26 will apply a force to the corresponding surfaces 28 of the handle expansion members 24 which will thereby cause the handle expansion members 24 to be displaced relative to the handle 12, i.e., to be moved from a resting state in which the handle 12 has a first cross-sectional profile as illustrated in FIG. 2 towards a fully activated state in which the handle 12 has a second cross-sectional profile as illustrated in FIG. 3, which second cross-sectional profile provides a torque induced, improved gripping surface for the user. While not required, in a preferred embodiment, the exterior surface of the handle expansion members 24 will be generally flush or continuous with the exterior surface of the handle 12 when the tool 10 is in the resting state.

Figure 6:
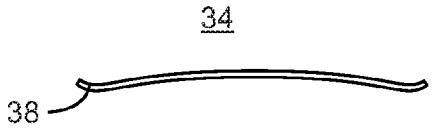
FIG. 6 illustrates a side view of a spring member of the tool of FIG. 1.

For use in maintaining each of the handle expansion members 24 within their respective slots 22, the handle expansion members 24 are further provided with one or more interiorly located ledges or tangs 32 such that the interior portion of the handle expansion members 24 are larger than the openings in the handle 12 that are provided by the slots 22. Furthermore, for allowing the handle 12 to be automatically returned to its resting state upon the removal of torque, one or more spring elements 34 are preferably interposed between the tangs 32 of the handle expansion members 24 and interior surfaces 36 formed in the handle 12. To this end, the spring elements 34, an example of which is illustrated in FIG. 6, can be in the form of a leaf spring that will function to bias the handle expansion members 24 towards their handle resting state position. In addition, the spring elements 34 can be provided with over travel stops 38 to further inhibit, in connection with the facing interior surfaces 36 of the handle 12, the outward, movement of the handle expansion members 24 and, thereby, limit the degree to which the working member 14 can be rotated relative to the handle 12. In alternative arrangements, the spring elements 34 can be in the form of a compression or extension spring which springs may incorporate an additional feature, as desired, to provide the over travel stop functionality. Furthermore, while the tangs 32 and spring elements 34 have been illustrated as extending in a longitudinal direction along the sides the of the expansion members 24, it will be appreciated that this arrangement is not intended to be limiting and that other arrangements can be used to perform the same functions of maintaining the handle expansion members 34 within the handle 12 while biasing the handle expansion members 34 towards their resting position.

Figure 7:
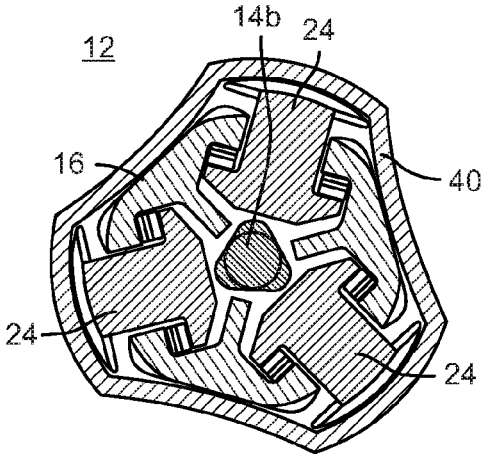
FIG. 7 illustrates a further cross-sectional view of the handle taken along line IV-IV in FIG. 3 with an optional flexible bladder having been applied to the handle.

For preventing dirt and debris from getting inside the slots 22 of handle 12 and for affecting the comfort of the interface between the users hand and the handle 12, including the handle expansion members 24, e.g., to provide a relatively smooth handle surface regardless of the cross-sectional state of the handle 12, a bladder 40 constructed from a resilient material can be provided over the handle 12. To this end, the bladder 40 would be sized to at least cover the portion of the handle 12 that includes the handle expansion members 24 as shown in FIG. 7.

While various concepts have been described in detail, it will be appreciated by those skilled in the art that various modifications and alternatives to those concepts could be developed in light of the overall teachings of the disclosure. For example, while the exemplary tool is illustrated as having three slots and three handle expansion members that are equidistantly spaced about the handle, it is to be understood that is not intended to be limiting. Similarly, while described in the context of a screwdriver, those of ordinary skill in the art will appreciate that the teachings set forth herein may be readily adapted to handles of other tools to achieve the same objectives that are expressly and inherently described herein. Accordingly, it will be appreciated that the particular concepts disclosed are meant to be illustrative only and not limiting as to the scope of the invention which is to be given the full breadth of the appended claims and any equivalents thereof.

What is claimed is:

1. A tool, comprising:

a working member, the working member having a portion providing a plurality of cam surfaces;

a plurality of expansion members;

a handle rotatable relative to the working member, the handle having a longitudinally extending chamber in which the portion of the working member is disposed and having a plurality of slots in which the plurality of expansion members are disposed such that, when a torque is applied to the tool, the cam surfaces of the portion of the working member cooperate with the plurality of expansion members to cause at least a portion of each of the plurality of expansion members to be moved outwardly from the slots to thereby cause the handle to change from having a first cross-sectional shape to a second cross-sectional shape; and at least one spring interposed between and in contact with each of the plurality of expansion members and the handle for causing the handle to revert back to the first cross-sectional shape upon a removal of the torque as applied to the tool.

2. The tool as recited in claim 1, further comprising a bladder constructed from a resilient material overlaying the handle and covering at least the plurality of expansion members.

3. The tool as recited in claim 1, wherein the at least one spring comprises a leaf spring.

4. The tool as recited in claim 1, wherein each of the plurality of expansion members comprises a pair of ledges that longitudinally extend along opposed sides of each of the plurality of expansion members and wherein the at least one spring is interposed between and in contact with at least one of the pair of ledges and the handle.

5. The tool as recited in claim 1, wherein the handle comprises a first portion that is mated with a second portion.

6. The tool as recited in claim 1, wherein the working member comprises a shaft having a fastener driving element.

7. The tool as recited in claim 1, wherein the cam surfaces provide the portion of the working member with a generally triangular shape.

8. The tool as recited in claim 1, wherein the plurality of expansion members comprises at least three expansion members equidistantly spaced about the handle.

9. The tool as recited in claim 1, wherein the at least one spring comprises a compression spring.

10. The tool as recited in claim 1, wherein the at least one spring comprises an extension spring.

* * * * *